US007632557B2

(12) United States Patent
Stolarczyk et al.

(10) Patent No.: US 7,632,557 B2
(45) Date of Patent: Dec. 15, 2009

(54) METHOD FOR RESTORING USED RAILROAD TIES AND THE RESTORED RAILROAD TIES FORMED THEREBY

(75) Inventors: Craig B. Stolarczyk, Eugene, OR (US); Paul D. Rogers, Eugene, OR (US); Philip N. Cote, Eugene, OR (US)

(73) Assignee: Williamette Valley Company, Eugene, OR (US)

( * ) Notice: Subject to any disclaimer, the term of this patent is extended or adjusted under 35 U.S.C. 154(b) by 541 days.

(21) Appl. No.: 11/383,855

(22) Filed: May 17, 2006

(65) Prior Publication Data

US 2008/0251594 A1 Oct. 16, 2008

(51) Int. Cl.
*B32B 3/26* (2006.01)

(52) U.S. Cl. ..... 428/63; 238/370; 156/94; 264/36.22

(58) Field of Classification Search ..... 428/63; 238/370; 156/94
See application file for complete search history.

(56) References Cited

U.S. PATENT DOCUMENTS

| | | | | |
|---|---|---|---|---|
| 4,295,259 | A | 10/1981 | Rhodes et al. | |
| 5,952,053 | A | 9/1999 | Colby | |
| 5,952,072 | A | 9/1999 | Colby et al. | |
| 6,455,605 | B1 | 9/2002 | Giorgini et al. | |
| 7,138,437 | B2 * | 11/2006 | Giorgini et al. | 521/101 |

* cited by examiner

*Primary Examiner*—Alexander Thomas
(74) *Attorney, Agent, or Firm*—Marger Johnson & McCollom, PC

(57) ABSTRACT

This invention provides a method for restoring at least one means defining a railroad spike hole located in a used railroad tie. In this way, the restored railroad tie can be reused in subsequent rail replacement operations. The restored railroad tie is capable of having a railroad spike penetrate and be retained within the confines of the restored railroad spike hole without substantial bending problems. The used railroad tie provided has at least one spike hole located therein. In each the means defining a railroad spike hole is formed a polymeric plug. The polymeric plug comprises a polymeric plug formed of a polymeric material including a plurality of flexible, readily deformable micro-inclusions which allow the formation of spike insertion pathways that track the insertion forces of the railroad spike as it is driven into a material thereby facilitating introduction of the railroad spike into said polymeric plug. The polymeric plug is capable of penetration by and retention of the railroad spike there within.

19 Claims, No Drawings

METHOD FOR RESTORING USED RAILROAD TIES AND THE RESTORED RAILROAD TIES FORMED THEREBY

BACKGROUND OF THE INVENTION

This invention relates to a method for restoring used railroad ties having pre-existing spike holes, and more particularly to a method for plugging the pre-existing spike holes in the used railroad ties thereby forming the restored railroad ties which can be reused in rail replacement operations.

All maintenance of the rails in railroad operations typically means removing the rail spikes from the railroad ties. In many instances, these railroad ties are structurally usable because they have not deteriorated to a point requiring replacement. However, reusing these ties requires plugging of any spike holes existing in the railroad tie structure.

Generally, these spike holes can be plugged. In this way, when spikes are re-driven into the holes, the spikes will be firmly anchored within the confines of the ties.

In certain conventional practice, the ties are plugged by manually driving hardwood dowels into the spike holes. Unfortunately, the use of hardwood dowels results in several problems. First, the dowels do not completely fill the hole. This causes moisture infiltration during use that ultimately accelerates tie rot and in turn the deterioration of the railroad ties structure. Also, as compared with the original unused virgin railroad ties, the hardwood dowels do not effectively anchor the spikes into the structural railroad tie member.

The use of wood substrates and polymeric materials have been described in the prior art as follows: Method for Restoring Used Railroad Ties and the Restored Railroad Ties Formed Thereby (U.S. Pat. No. 5,952,072), Process For Producing Filled Polyurethane Elastomers (U.S. Pat. No. 5,952,053), Foamable Composition Exhibiting Instant Thixotropic Gelling (U.S. Pat. No. 6,455,605), Method of Filling Spike Holes in Railway Ties (U.S. Pat. No. 4,295,259), all of which are incorporated herein by reference.

It is desirable to provide an effective and efficient method for filling spike holes in used railroad ties which will then produce restored filled railroad ties which can be reused in rail replacement operations. Such a method should preferably have the following attributes: (a) firmly anchoring the spike into the tie; (b) deeply infiltrate the small cracks and crevices in the wood surface forming the spike hole to impede tie rot due to moisture; (c) bond tightly with the wood to prevent moisture infiltration; (d) be re-spikable within a relatively short time after dispensing; (e) displace standing water in tie holes during the hole filling operation; (f) dams leaky tie holes to enable complete filling. As for the filled portion of the railroad tie, it should anchor the spike in a manner which is comparable to introducing a railroad spike into the virgin wood portion of the subject railroad tie. Of particular importance is providing a filled spike hole which meets the needs described above but which is capable of allowing the railroad spike to effectively penetrate the filled material without substantial bending problems.

SUMMARY OF THE INVENTION

The needs expressed above have been fulfilled by restored railroad tie in which the existing spike holes have been filled according to the teachings of the present invention.

More specifically, this invention provides a method for restoring at least one means defining a railroad spike hole located in a used railroad tie. In this way, the restored railroad tie can be reused in subsequent rail replacement operations.

The restored railroad tie is capable of having a railroad spike penetrate and be retained within the confines of the restored railroad spike hole without substantial bending problems. The used railroad tie provided has at least one railroad spike hole located therein.

This invention is directed to a product and a method for restoring used railroad ties having pre-existing spike holes. The subject product and method relates to the use of polymeric materials which more effectively and efficiently plug the spike holes which results in the formation of the fully restored used railroad tie. The polymeric plug infiltrates and tightly bonds within the railroad spike hole to prevent moisture infiltration. Thus, substantial tie rot due to moisture is impeded, and the leaky railroad spike hole means is effectively and efficiently dammed to enable complete filling thereof. The polymeric plug is capable of penetration by, and retention of the railroad spike there within.

The foregoing and other objects, features and advantages of the invention will become more readily apparent from the following detailed description of a preferred embodiment which proceeds with reference to the drawings.

DETAILED DESCRIPTION OF A PREFERRED EMBODIMENT

A restored used railroad tie that can be reused in subsequent rail replacement operations and a method for restoring at least one means defining a railroad spike hole located in a used railroad tie is provided herein. Thus, the restored railroad tie can be reused in subsequent rail replacement operations. The restored railroad tie is capable of having a railroad spike penetrate and be retained within the confines of the restored railroad spike hole means without substantial bending problems. The subject method comprises providing the used railroad tie having at least one means defining a railroad spike hole located therein.

A polymeric plug is formed in each railroad spike hole. The polymeric plug is formed of a polymeric material including a plurality of flexible, readily deformable inclusions which permits the formation of a spike insertion pathway. Simultaneously, it allows for the insertion of a spike while deforming wood grain at the interface between the plugging material and the restored railroad tie. The tracking of the forces during the insertion of the railroad spike allows for gaining insight concerning the spike insertion pathway. This can be accomplished by tracking the forces as the railroad spike is driven into the plug material. Introduction of the railroad spike into the polymeric plug, which has infiltrated and tightly bonded within the railroad spike hole, prevents moisture infiltration thereby impeding substantial tie rot due to moisture. The damming of the leaky railroad spike hole is a means to enable complete filling thereof.

The flexible inclusions that may be introduced into the material typically are comprised of polymeric micro-balloons. Preferably, the inclusions comprise surface treated polymeric micro-balloons. More preferably, the treated polymeric micro-balloons comprise coated polymeric micro-balloons. The most preferred inclusions are calcium carbonate-coated polymeric micro-balloons. The flexible inclusions can be provided in an amount up to about 3.0 weight %, preferably up to about 2.5 weight %, more preferably up to about 2.0 weight %, and most preferably up to about 2.0 weight %, base on the total weight of the polymeric plug material. Flexible inclusions, such as the polymeric micro-balloons described above, have been found to provide for improved interactions between polymer matrix and the flexible inclusions. In this way, the performance of the material under load will be enhanced as determined by scanning electron microscopy (SEM) imaging after sample loading. These inclusions should not exhibit rampant debonding nor should they deleteriously impact the bulk thermal properties of the system. The Dualite MS7000 flexible micro-balloons can be employed as the flexible inclusions in this invention.

The polymeric material is typically a substantially non-cellular material. Polyureas, polyurethanes and polyurea/polyurethane hybrid polymers are particularly useful in this invention. Preferably, the polymeric material is a polyurethane material. More preferably, the polymeric material is a polyurea material. Most preferably, the polymeric material is a poly(urethane-urea) material. These polymers are prepared from various combinations of amine terminated and hydroxyl terminated resins which are reacted with an isocyanate material. Preferred polymeric plug materials contain an isocyanate terminated prepolymer to improve phase miscibility. These isocyanate terminated prepolymers preferably controls the structure of the hard segments in microscopic regions where the isocyanate components tend to congregate in a polyurethane-polyurea, or poly(urethane-urea) compound. Phase miscibility can be measured by atomic force microscopy (AFM), tunneling electron microscopy, SEM in conjunction with chemical etching, or variable pressure scanning electron microscopy. The observed morphology is then related to the measured mechanical properties.

The polymeric plug of the subject invention typically has a density of greater than about 30 lb/ft$^3$, preferably at least about 40 lb/ft$^3$, more preferably at least about 50 lb/ft$^3$, and most preferably from about 60 lb/ft$^3$, preferably up to about 120 lb/ft$^3$, more preferably up to about 100 lb/ft$^3$, and most preferably up to about 90 lb/ft$^3$.

The polymeric plug can further include other additives. These additives can comprise mineral fillers, glass spheres, glass fibers, ceramic spheres, or polymeric solid particles.

The polymeric material of this invention which is employed for the repair of a railroad spike hole that demonstrates improved rheological characteristics. The presence of these theological properties allows for increased flow rates from storage totes. The flow rate increases are due to a great extent to viscosity reduction and lower levels of fluid structure as determined by dynamic theological experiments. Also, reduced wear of application equipment can be realized due to attrition. This is attributable to the presence of a lower viscosity material and to the use of less abrasive fillers. The subject polymeric material exhibits an increased material storage stability. The enhanced stability is due to (a) the use of materials with surface energies and surface tensions that are more closely matched; and (b) the judicious use of rheological modifiers. Moreover, enhanced filling of defect sites without drainage from repair site can be accomplished when the polymeric material of this invention is employed.

The polymeric plug of the present invention has a lower insertion pathway for materials within a given density classification. The insertion pathway allows for a complete insertion of the spike without causing substantial spike bending, deviations of the spike from the polymeric material, or undue material damage. Thus, the spike can be introduced while allowing for local increases of wood density due to grain deformation.

The presence of a suitably functioning insertion pathway is integral to enhancing spike insertion and retention behavior. The insertion pathway is described by the load versus displacement curve generated when driving a spike into the polymeric material. This property is based upon the geometry of the test site when the insertion/extraction forces are evaluated after the polymeric material is introduced into a railroad tie.

With the new approach of this invention, polymer density levels can be increased since the properties of the polymer itself constitutes the principal means for controlling the insertion process of a railroad spike, as opposed to the conventional approach which is a function of the presence of a reduced polymer density due to presence of micro-cellular features. Standard tests show a reduction of insertion forces at low deflection values of preferably up to about 50% relative to the highest rated polymeric plug materials presently available in the marketplace. Modified test methods demonstrate a preferred reduction of up to 50% in insertion forces at the initial phase in the insertion process, and a preferred reduction in insertion forces of up to about 30% for complete insertion utilizing methods that allow for the isolation of the polymer. The restored used railroad ties display reduced spike insertion forces relative to comparable ties using existing polymeric plug materials. The insertion pathway is 20% lower than for these other materials of comparable density, even though they maintain target strength and modulus values required for this application.

When the polymeric plugging material is introduced into the spike holes in the field, they form a stable plug at ambient temperatures by an in situ polymer reaction process. The lower range of operating temperatures for conducting this in situ reaction typically requires the use of trace line heaters in order to facilitate the completion of the subject polymeric curing step. However, the use of trace line heaters makes the plug formation increasingly tedious and difficult for the workers in the field. Contrarily, the polymer plug material formation can be conducted within an expanded range of operating temperatures without the use of trace line heaters. Trace line heaters are used to ensure that the holes are adequately filled, by increasing the temperature of the mixed resin, thereby reducing the viscosity.

The reduction of trace line usage over a much wider operating temperature range can be accomplished through the use of the polymer plugging material of this invention. This represents an overall simplification of the protocols required for material use by workers in the field. It also lowers the energy requirements for the plug formation equipment (energy savings). Currently, trace lines are activated for temperatures lower than about 80° F. Typically, the trace lines temperatures are set for about 90-120° F. When the subject polymers are employed as the plugging material, trace line heating is preferably not necessary until the temperature is lowered to about 40° F., more preferably about 50° F., and most preferably about 60° F.

Rheological profiles of this invention allow for avoiding the necessity of using trace line heating until reaching temperatures below, for example, 40° F. The spike insertion pathway tracks the insertion forces of a spike as it is driven into a material. Values can be recorded either continuously or at discrete distances over the course of a spike's travel into the polymeric material. The polymeric plug material of the present invention shows lowered insertion forces than materials of similar density.

The interphase morphology of the polymeric plug materials employed herein can facilitate improved stress relief. Stress relief is measured directly through creep experiments using dynamic mechanical analysis (DMA). It can also be inferred by examining the state of a material via SEM after loading according to a prescribed schedule or after mechanical testing. Achieving the preferred stress relief levels in turn results in decreased opposed forces which act to negatively impact the insertion of a railroad spike into the polymeric plug. For example, these insertion forces can be tracked using a mechanical loading machine to drive a nail (spike) into a polymer sample. Exemplary testing to determine the stress relief level can use a 0.5 in×0.75 in rectangular cross sectional area, or a 2 inch circular cross sectional area, in a railroad tie.

The subject polymeric plug materials also exhibit a lower polyurethane index. The polyurethane index is the ratio of functional equivalents of isocyanate to functional equivalents of alcohol. A lower polyurethane index offers the benefit of reducing cellular formation when the material is properly dispensed in an aqueous environment. Cellular formation may be evaluated directly using SEM techniques.

Workers who use the polymeric plug materials will also reap the benefit of a product which has a lower viscosity. Thus, this polymeric plug material will mix more readily and will also allow for better penetration into railroad tie defects so that the timing of the plug formation will be reduced and it will require less effort on the part of the worker to restore the railroad tie. For purposes of this invention, defect penetration is measured by filling a defect in a railroad tie with the polymeric plug material under circumstances which replicate field conditions. The railroad tie is then cross-cut or is torn apart with a hammer and chisel to directly observe the efficacy of defect filling operation.

The restored used railroad ties herein exhibit excellent mechanical properties which are directly based on the strength and relative flexibility of the subject polymeric plug material. These properties also substantiate the relative deformation tendencies of a material under axial, shear, or compressive loading. Furthermore, these properties have shown good performance under load.

Performance under load tracks the change in material properties after particular loading schedules. A servo-hydraulic loading machine can be used to load a material at various frequencies and forces. Evaluations may also be performed using DMA.

A flow rate describes the volume (or mass) of material that will flow under certain conditions. The subject polymeric plug materials offer enhanced flow rates under gravitational conditions.

Material strength should be maximized within the aforementioned elongation and modulus constraints. A preferred minimum tensile strength should be at least about 2100 psi.

In order to ensure good lateral resistance to load, a preferred minimum Young's modulus of preferably from about 600 Mpa, more preferably from about 700 Mpa, more preferably from about 800 Mpa, preferably up to about 1500 Mpa, more preferably up to about 1400 Mpa, and most preferably up to about 1200 Mpa, should be provide in the tie plugging compounds. Thus, the polymeric plug material will achieve a desirable resistance level to a maximal load while allowing for reduced forces which facilitate spike insertion.

A test method which can determine preferred insertion and extraction strength of a polymeric plug is to analyze a 200 $cm^3$ cylindrical sample by driving a 7-D nail into the sample using an Instron mechanical testing machine at 0.35. in/min up to a depth of 0.7 inches. Insertion forces are typically not greater than about 700 lbf, preferably not greater than about 650 lbf, more preferably not greater than about 600 lbf, and most preferably not greater than about 500 lbf. Extraction forces are also dependent upon sample geometry. A preferred method for evaluation is to use an Instron Mechanical testing machine to pull the 7-D nails out at 0.5 in/min. The minimum extraction force is preferably at least about 200 lbf, more preferably at least about 150 lbf, and most preferably at least about 100 lbf.

Further additives may include mineral fillers, glass spheres, glass fibers, ceramic spheres, rubber inclusions, or polymeric spheres. Ideally, the surface energy of the inclusions should either match the surface energy of the polymer matrix or exhibit good bonding after the application of mechanical stress as determined by SEM.

Extender materials may also be added to the tie plugging composition. Preferably, polyols and polyamines may be used for these extender materials, the most preferred extender materials being PPG, PEG, hydroxyl capped polyesters, castor oil, 2-ethyl-1,3-hexanediol, and hydroxyl/amine capped polybutadiene.

EXAMPLE 1

An illustrative example of the method for producing the subject polymeric material for restoring used railroad ties having pre-existing spike holes is as follows:

Polyol resin preparation procedure: Use a Moorehouse Cowles laboratory mixer equipped with a 3.33 in diameter disk type blade. A 4-quart stainless steel flask with a 6.05 inch diameter should be used to contain the reagents during the mixer process. Add the following liquids to the tared stainless steel flask, measuring the appropriate amounts of material according to mass specifications:

| Material Class | Item | Grams |
|---|---|---|
| polyol | 3000 Molecular Weight Polyol | 59.96 |
| polyol | 700 Molecular Weight Polyol | 380.13 |
| chain extender | PPG-425 | 41.90 |
| chain extender | Vestamine IPD | 22.07 |
| chain extender | EPI-Cure 3271 | 3.06 |
| chain extender | 2-Ethyl-1,3-Hexanediol | 84.10 |
| wetting/dispersing agent | ANTI-TERRA-U 100 | 2.02 |
| defoamer | BYK-066N | 5.63 |

Turn power control for mixer on, increasing mix speed to 750 RPM. Mix liquids for five minutes. Using a tared 1-quart plastic container for the Aerosil fumed silica and a tared aluminum weighing pan for the pigment, measure out the following mass of materials, adding to the stainless steel flask under continuous agitation:

| Material Class | Item | Grams |
|---|---|---|
| rheology modifier | AEROSIL 200 | 31.98 |
| pigment | Yellow Iron Oxide Powder | 11.05 |

Mix the fumed silica and pigment into the liquids for five minutes, increasing mixing speed to 1500 RPM. At the end of the mixing period, reduce the mixing speed to 750 RPM. Using a tared 1-quart plastic container for the Micorna 7 modifier, measure out the following mass of materials, adding to the stainless steel flask under continuous agitation:

| Material Class | Item | Grams |
|---|---|---|
| filler (calcium carbonate) | MICRONA 7 | 399.67 |
| moisture control additive | PURMOL 3ST SIEVE | 29.54 |
| catalyst | Bismuth Neodecanoate | 4.50 |

-continued

| Material Class | Item | Grams |
|---|---|---|
| catalyst | Zinc Neodecanoate | 3.23 |
| rheology modifier | BYK-410 | 3.30 |

Mix the reagents into the fluid for 10 minutes, scraping excess material from the sides of the mixer back into the bulk of the agitated fluid/resin. Using a tared 1-quart plastic container, measure out the following mass of polymeric micro-balloons, adding to the stainless steel flask under continuous agitation:

| Material Class | Item | Grams |
|---|---|---|
| micro-balloon | Dualite MS7000 | 10.80 |

Mix the reagents into the fluid for 15 minutes, scraping excess material from the sides of the mixer back into the bulk of the agitated fluid/resin. Upon completion, remove the polymeric material and place into appropriate laboratory container.

We claim all modifications coming within the spirit and scope of the accompanying claims.

The invention claimed is:

1. A method for restoring at least one means defining a railroad spike hole located in a used railroad tie, so that the restored railroad tie can be reused in subsequent rail replacement operations, said restored railroad tie being capable of having a railroad spike penetrate and be retained within the confines of the restore railroad spike hole means without substantial bending problems, which comprises:

providing said used railroad tie having at least one means defining a railroad spike hole located therein; and forming in each said means defining a railroad spike hole, a polymeric plug formed of a polymeric material including a plurality of flexible, readily deformable micro-inclusions which allow for spike insertion pathways for the railroad spike as it is driven into a material thereby facilitating introduction of said railroad spike into said polymeric plug, said micro-inclusions comprising polymeric micro-balloons, said polymeric plug infiltrating and tightly bonding with the railroad spike hole means to prevent moisture infiltration thereby impeding substantial tie rot due to moisture, and to dam the leaky railroad spike hole means to enable filling thereof.

2. The method of claim 1, wherein said inclusions comprise treated polymeric micro-balloons.

3. The method of claim 2, wherein said treated polymeric micro-balloons comprise coated polymeric micro-balloons.

4. The method of claim 1, wherein said polymeric material is substantially non-cellular.

5. The method of claim 1, wherein said polymeric material is a polyurethane material.

6. The method of claim 1, wherein said polymeric material is a polyurea material.

7. The method of claim 1, wherein polymeric material is a poly(urethane-urea) material.

8. The method of claim 1, wherein said polymeric plug has a density of from at least about 40 lb/ft3, up to about 120 lb/ft3.

9. The method of claim 1, wherein said polymeric plug further include additives which comprise mineral fillers, glass spheres, glass fibers, ceramic spheres, or polymeric solid particles.

10. A restored used railroad tie that can be reused in subsequent rail replacement operations, comprising a railroad tie having at least one railroad spike hole located therein, said restored railroad tie being capable of having a railroad spike penetrate and be retained within the confines of the restored railroad spike hole without substantial bending problems, which comprises; and a polymeric plug, located in each said railroad spike hole, formed of a polymeric material, said polymeric material including a plurality of flexible, readily deformable micro-inclusions, said micro-inclusions comprising polymeric micro-balloons, which allow for spike insertion pathways as the railroad spike is driven into the polymeric material thereby facilitating introduction of said railroad spike into said polymeric plug and infiltrating and tightly bonding with the railroad spike hole means to prevent moisture infiltration thereby impeding substantial tie rot due to moisture, and damming the leaky railroad spike hole means to enable complete filling thereof.

11. The method of claim 10, wherein said inclusions comprise treated polymeric micro-balloons.

12. The method of claim 11, wherein said treated polymeric micro-balloons comprise coated polymeric micro-balloons.

13. The method of claim 10, wherein said polymeric material is substantially non-cellular.

14. The method of claim 10, wherein said polymeric material is a polyurethane material.

15. The method of claim 10, wherein said polymeric material is a polyurea material.

16. The method of claim 10, wherein polymeric material is a poly(urethane-urea) material.

17. The method of claim 10, wherein said polymeric plug has a density of from at least about 40 lb/ft3, up to about 120 lb/ft3.

18. The method of claim 10, wherein said polymeric plug further include additives which comprise mineral fillers, glass spheres, glass fibers, ceramic spheres, or polymeric solid particles.

19. A method for restoring at least one means defining a railroad spike hole located in a used wooden railroad tie, so that the restored railroad tie can be reused in subsequent rail replacement operations, said restored railroad tie being capable of having a railroad spike penetrate and be retained within the confines of the restored railroad spike hole means without substantial bending problems, which comprises:

providing said used railroad tie having at least one means defining a railroad spike hole located therein; and forming in each said means defining a railroad spike hole, a polymeric plug formed of a substantially non-cellular polymeric material including a plurality of flexible, readily deformable micro-inclusions comprising a plurality of polymeric micro-balloons which allow for the formation of spike insertion pathways as the railroad spike is driven into a material thereby facilitating introduction of said railroad spike into said polymeric plug, said polymeric plug infiltrating and tightly bonding with the railroad spike hole means to prevent moisture infiltration thereby impeding substantial tie rot due to moisture, and to dam the leaky railroad spike hole means to enable filling thereof.

* * * * *